US006708839B2

(12) United States Patent
Diesterbeck

(10) Patent No.: US 6,708,839 B2
(45) **Date of Patent: *Mar. 23, 2004**

(54) PLASTIC CONTAINER WITH SNAP LID AND A SEALING WEB LOCATED ON THE INSIDE OF THE CONTAINER

(75) Inventor: Frank Diesterbeck, Marienheide (DE)

(73) Assignee: Jokey Plastik Gummersbach GmbH, Gummersbach (DE)

( * ) Notice: Subject to any disclaimer, the term of this patent is extended or adjusted under 35 U.S.C. 154(b) by 73 days.

This patent is subject to a terminal disclaimer.

(21) Appl. No.: 09/822,874

(22) Filed: Apr. 2, 2001

(65) Prior Publication Data

US 2002/0175174 A1 Nov. 28, 2002

(30) Foreign Application Priority Data

Apr. 1, 2000 (DE) ..... 200 06 094 U

(51) Int. Cl.[7] ..... B65D 41/18

(52) U.S. Cl. ..... 220/782; 215/DIG. 1; 206/508; 220/792; 220/795; 220/787; 220/790; 220/658; 220/659

(58) Field of Search ..... 220/780, 782, 220/783, 784, 787, 789, 790, 792, 795, 656, 658, 657, 659, 378; 215/DIG. 1; 206/508

(56) References Cited

U.S. PATENT DOCUMENTS

| | | | | |
|---|---|---|---|---|
| 3,532,244 A | * | 10/1970 | Yates, Jr. | 215/272 |
| 3,556,338 A | | 1/1971 | Wilkinson et al. | |
| 4,027,778 A | | 6/1977 | Tupper | |
| 4,256,240 A | * | 3/1981 | Woinarski | 206/508 |
| 4,574,974 A | | 3/1986 | von Holdt | |
| 4,998,622 A | | 3/1991 | Drack | |
| 5,143,219 A | * | 9/1992 | Yates, Jr. | 206/508 |
| 5,303,839 A | | 4/1994 | Blumenschein | |
| 5,368,182 A | | 11/1994 | Schutz | |
| 5,593,060 A | | 1/1997 | Przytulla | |
| 6,170,691 B1 | * | 1/2001 | Morris et al. | 206/508 |
| 6,325,226 B1 | * | 12/2001 | Krautkramer | 215/252 |
| 2001/0010311 A1 | * | 8/2001 | Ciccone | 220/276 |

FOREIGN PATENT DOCUMENTS

| | | |
|---|---|---|
| DE | 1 900 955 | 6/1964 |
| DE | 30 32 366 | 4/1982 |
| DE | 31 32 829 | 6/1982 |
| DE | 31 08 949 | 7/1982 |
| DE | 42 40 629 | 6/1994 |
| DE | 200 06 093 U1 | 10/2000 |
| DE | 200 06 095 U1 | 10/2000 |
| EP | 0 486 808 | 5/1992 |
| GB | 1 489 515 | 10/1977 |

* cited by examiner

*Primary Examiner*—Robin A. Hylton
(74) *Attorney, Agent, or Firm*—Browdy and Neimark, P.L.L.C.

(57) ABSTRACT

A plastic container with a snap lid and with a snap element provided on the upper edge area of the container for the lid to snap onto, the lid having an area in tight contact with the container's upper edge area. The container edge on the side of the snap element facing the top edge of the container is provided with at least one integrally molded reinforcing rib projecting radially and extending over at least a segment of the circumference of the container, preferably running circumferentially around the container. The reinforcing rib may be provided on a downward-facing, circumferential collar region, which is joined in the region of the top edge of the container.

37 Claims, 8 Drawing Sheets

PLASTIC CONTAINER WITH SNAP LID AND A SEALING WEB LOCATED ON THE INSIDE OF THE CONTAINER

BACKGROUND OF THE INVENTION

1. Technical Field

The invention relates to a plastic container with a snap lid and with a snap element provided on the upper edge area of the container for the lid to snap onto, where the lid surrounds the top and outside of the container edge and sits tight against the container edge.

2. Prior Art

Plastic containers of this kind are used to transport various goods, particularly also in the industrial and food sectors, and have proven to be very effective for this purpose. However, transporting liquids or low-viscosity materials still involves the problem of the sufficient leak-proofness of the plastic containers, particularly also when transporting volatile or other types of critical goods, such as oils or mineral oils, where this leak-proofness should reliably be maintained, especially also in the event of external effects, such as blows or jolts, or of the plastic container falling. These high demands have not yet been fulfilled satisfactorily by previously known plastic containers, meaning that critical goods are still usually transported in metal containers.

OBJECT AND SUMMARY OF THE INVENTION

An object of the invention is to provide a plastic container with snap lid, which reliably fulfills the special demands imposed on leak-proofness, particularly when exposed to external forces.

The object is solved by a plastic container with snap lid, in which the container edge on the side of the snap element facing the top edge of the container is provided with at least one integrally moulded reinforcing rib projecting radially inward and/or outward and extending over at least a segment of the circumference of the container. The reinforcing rib is thus located between the snap element and the top edge of the container. The reinforcing rib can be provided on the side of the container opposite the snap element, but is advantageously located on the same side. The snap element and the reinforcing rib are advantageously located on the outside of the container and engaged from above by the lid. The reinforcing rib further stabilises the top edge of the container and thus the sealing region between the container and the lid. In this context, the "reinforcing rib" is taken to mean a rib that is provided in addition to a snap projection and thus not associated with a corresponding snap edge of the lid.

The reinforcing rib preferably runs radially around the container, although it can also be divided and consist of several, e.g. segmented reinforcing areas that are distributed around the circumference. One or more additional reinforcing ribs, which can each run radially around the container, can alternatively or additionally be integrally moulded on the side of the snap element facing towards, or also away from, the top edge of the container. The thickness, i.e. height and/or width of the reinforcing rib can be in the region of half the wall thickness of the container, preferably in the region of the wall thickness or greater than it. If necessary, it can also be less than half the wall thickness, particularly if the rib is structured, as long as it significantly reinforces the upper region of the container.

The lid preferably sits on the radially outer or inner side of the reinforcing rib with or without pretension, so that lateral forces acting on the lid are immediately absorbed by the reinforcing rib. To this end, the radial edge of the reinforcing rib can have a plane area. The distance between the reinforcing rib and the snap element, or between them, can be designed to catch the snap edge of the lid, so that the lid can be pre-locked on the container.

Advantageously, the snap connection of the lid is also equally effective after the container has been opened once, i.e. the snap region and the sealing region are not separated by an area of thinner material, which serves as a tamper-proof seal, for example, and in which the lid area has to be partially or completely removed or folded over in order to open the container.

The upper edge of the container preferably has a circumferential collar region projecting radially outward and facing downward, on which a tamper-proof seal can be provided, for example. The circumferential collar region is preferably radially flush with the height of the lid rim, or projects radially beyond it. The snap edge is preferably integrally moulded on the circumferential collar. A reinforcing rib integrally moulded above the snap element and preferably facing outward can also be integrally moulded on the circumferential container collar, thus also reinforcing it, and/or above the circumferential collar region right on the container wall in the region of the top edge of the container. Due to the downward-facing collar region, which is spaced apart from the container wall, the snap region is isolated from the sealing region in terms of the forces acting on them. The reinforcing rib is preferably integrally moulded on the top edge of the circumferential collar, or on the container wall, right on the top edge of the container, without being restricted to this. For example, the reinforcing rib can also be located a small distance away from the top edge of the circumferential collar or the container collar, e.g. at distance of one or a few times the wall thickness or the thickness of the reinforcing rib.

The snap element and the reinforcing rib can also be integrally moulded on the container wall above the circumferential collar.

The downward-facing, circumferential collar region is preferably joined at the top edge of the container, i.e. at the height of the sealing region or at a distance of a few times the wall thickness away from it, e.g. one or two times the wall thickness, without being restricted to this.

The lid preferably has an outwardly-facing sliding bevel, which can be joined to the top edge of the lid or a region below it, preferably on an essentially vertical section. The sliding bevel can be located immediately above the reinforcing rib provided above the snap element on the outer wall of the container and a small distance away from it. The sliding bevel can be radially flush with the snap edge of the lid on the outside, or extend beyond it, although it preferably extends radially beyond the areas projecting away from the container wall.

The container preferably has a collar region projecting radially outward and facing downward, which is located below the lid when it is on the container and extends radially to the lid or also beyond it. This circumferential collar region can be integrally moulded on the container wall separately and, in this context, be flush with the bottom edge of the circumferential collar region with the snap edge, or spaced apart from it in terms of height. This circumferential collar region is preferably designed as a continuation of the collar region accommodating the snap element, i.e. as a shoulder continuing down and to the outside. A corresponding tamper-proof seal can be provided in this area. The bottom edge of the lid can sit on this collar region with or without pretension, or display a slight amount of play in relation to it, preferably such that the bottom edge of the lid cannot be reached under manually. This circumferential collar region can have a radial constriction for the partial or complete reception of the bottom edge of the lid.

The circumferential collar region or regions can be reinforced by vertical ribs, which can be mounted in the inside of the collar region and connected to the outer wall of the container. The reinforcing ribs preferably have a recess or notch at the bottom, due to which the collar region retains a certain degree of flexibility and can act as a deformation zone.

The sealing region between the container and the lid is preferably provided with a circumferential and possibly separate seal that sits tightly between the container and the lid when the lid is in place, where the seal is made of a material of greater elasticity than that of the lid and the bucket, particularly a rubber material.

It is particularly preferable for the flexible seal to be integrally moulded on the container and/or lid. This makes it possible to avoid the tolerances that can occur with the alternative possibility of providing a manually inserted seal, and the seal is also always located on the component in unmoveable fashion, even when exposed to external forces, e.g. if containers fall. The seal is preferably integrally moulded by an injection process, e.g. injection moulding, so that joints or the like can be avoided. The seal can be injected in the same mould immediately after the moulding of the associated container part, so that low manufacturing and fit tolerances, in particular, can be maintained.

The seal is advantageously integrally moulded on the lid. The seal can have an essentially horizontal sealing region and it can also be profiled, e.g. U or V-shaped. One, two or even more different sealing regions can be provided that differ in terms of their contact width, which can be either linear or planar, material thickness or other characteristics. The sealing regions can be interconnected and/or radially or axially separated from one another.

As a result of the arrangement of the reinforcing rib next to the flexible seal, the sealing region of the container is particularly stabilised.

The seal is advantageously located in a circumferential groove in the lid that is open towards the container edge, where the seal can extend over the entire width of the groove and is thus additionally secured against lateral shifting. The side flanks of the groove can surround the inside or outside of the container edge, preferably with slight lateral play, or none at all, without being restricted to this.

The seal preferably has two, adjacent sealing regions that are at different angles and tightly contact areas of the container edge at different angles. To this end, the seal can have a U, V or L-shaped cross-section, in particular, or other profiles, where the sealing regions can be arranged on opposite areas of the seal, possibly also in a convex area, for example.

When the container is closed, the seal preferably has an essentially horizontal area that tightly contacts the top edge of the container and a radially inward area that preferably slopes downwards and tightly contacts the inside of the upper container edge. The downwardly sloping sealing region can extend essentially vertically or at an angle when the container is in upright position, where the two sealing regions can enclose an angle of 90° to 135° or more. The container edge preferably likewise has a horizontal sealing region and a radially inward bevel or chamfer for positioning the vertical or angled sealing region. However, other designs are also possible. As a result, forces are always absorbed in the region of the flexible seal, even forces acting laterally on the sealing region, so that a high degree of leak-proofness is ensured.

The sealing region can have one or more circumferential sealing ribs projecting towards the container edge, which tightly contact the corresponding component, e.g. the container, particularly the top edge of the container. The sealing rib can be provided when using a flexible seal, as well as when the sealing region is created by a contact area between the container and the lid, e.g. is made of the same material as these components, or possibly also of some other material that need not have greater flexibility than these components. The contact area is preferably plane. It can extend horizontally and, for example, form the top edge of the container.

Regardless of the material selected, the height of the sealing rib is preferably less than the wall thickness of the adjacent component, e.g. the container, preferably less than ½ or ⅕ the container wall thickness or smaller, without being restricted to this. Particularly if the sealing rib is made of a material with a stiffness roughly equal to that of the container material, the sealing rib can also be of greater height.

The width of the sealing region, i.e. its radial extension, can be greater than the wall thickness of the upper container edge, e.g. approximately 1.5 to 3 times greater, without being restricted to this. This applies to flexible seals as well as to sealing regions without greater flexibility.

The container edge can be plane or provided with one or more circumferential ribs, pairs of which can form a groove that is at least partially engaged by one or more sealing ribs. The sealing ribs can be provided on different areas of the seal, e.g. on a horizontal and/or vertical or angled area. The cross-sections of the sealing ribs need not be the same as the circumferential grooves of the container edge, as long as a sufficient sealing effect is achieved. The cross-section of the groove of the container edge can be equal to or smaller than the cross-section of the sealing rib, so that the groove is completely filled by the flexible sealing rib when the lid is in place. The groove cross-section can also be larger than that of the engaging sealing ribs and, in this context, counteract the lateral shifting of the same, for example, a purpose that can also be fulfilled by just a web. The web or edge delimiting the groove can also tightly contact the seal. If necessary, one or more ribs can also be provided on the container edge that engage recesses provided specifically for this purpose in the flexible seal. In particular, the seal and container edge structures that come into contact, which can differ in terms of height and/or width, for example, can be incompatible or non-complementary, so that elevations on the seal do not lie opposite depressions in the container edge, but rather contact elevations on the container edge, e.g. in the flank area of the same. This results in non-congruent interlocking that ensures high and reliable leak-proofness. If the sealing rib is made of a material of sufficient stiffness, e.g. the container material, the sealing rib is accommodated by a preferably congruent groove, in which the sealing rib can also be located in a press fit.

The seal preferably has a height or thickness such that it simultaneously acts as a deformation zone when force is exerted on the container or the lid in the sealing region, so that deformation of the more rigid lid and container areas can be avoided when exposed to certain forces.

Webs projecting radially outward, which can be designed as circumferential ribs whose radial extension is less than the container wall thickness, can be integrally moulded on the outwardly downward-sloping area of the outer container wall adjacent to the top edge of the container. These ribs can be made of the same material as the container wall and essentially serve to reduce the friction when putting on the lid, where they only have a secondary sealing function, which is primarily fulfilled by the flexible and compressible seal. Two or more circumferential ribs of this kind can also be provided on the outer edge of the container. When the lid is in place, the ribs preferably make contact without play, but also without any significant pretension, so that the lid is precisely positioned in the region of the seal, or are spaced apart with slight play, without being restricted to this.

The lid preferably has a circumferential area that is spaced vertically and/or radially away from a possibly provided flexible seal and tightly contacts the inside wall of the container when the lid is in place. This sealing region can be made of the same material as the lid. The sealing region can be designed as a downwardly projecting rib or also as a shoulder on the underside of the lid, for example, and is preferably located above an indentation in the container wall when the lid is in place. When the lid is in place, the sealing region can rest on the indentation, or be spaced away from it, preferably in such a way that the underside of the rib or of the shoulder of the lid rests on the container indentation when additional containers are stacked on top or when an external force is applied. In this context, the lid area can tightly contact a preferably essentially vertical container region in linear fashion, or over a vertical height, preferably at the height of a reinforcing rib or the snap edge provided on the outside of the container.

The reinforcing rib is preferably located at least roughly at the height of an area of the lid that directly contacts the inside wall of the container. The lid area is preferably designed as a circumferential sealing region. The vertical distance of the rib from the contact area of the lid on the inside wall of the container can be in the region of 0 to 5 times the container wall thickness, such as in the region of roughly 1 to 2 times the container wall thickness, without being restricted to this. In this context, the reinforcing rib can be provided above, below or exactly level with the contact area between the lid and the inside wall of the container.

In order to increase the reliability of the container seal, an area projecting upward beyond the bottom edge of the rib can be provided on the inside wall of the container, which is radially inside relative to the web-like or circumferential rib integrally moulded on the inside of the lid. To this end, individual projections or webs can provided that are spread over the circumference. This area is preferably also designed as a circumferential rib. The height of this rib, which prevents inward shifting of the rib of the lid, is preferably smaller than the wall thickness of the container or the lid rib, without being restricted to this. The upwardly projecting areas of the container can be slightly spaced apart or contact the side of the rib of the lid with or without pretension. In this context, the rib of the lid can also be located in a press fit between the radially adjacent container areas on the inside and outside.

The shoulder of the inside wall of the container, which is located below the rib or a shoulder of the lid or the like, can be located roughly at the height of the snap element or a reinforcing rib, or at distance of one or a few times the wall thickness of the container.

In order to stabilise the sealing region, the lid can be provided, preferably on the immediately radially inside area of the container wall, with at least one radially inward projection that can be integrally moulded on the top side of the lid. The projection or projections can be of annular, box-like (e.g. cubic or prismatic) or web-shaped design, without being restricted to this. Inside reinforcing ribs can be provided in order to stabilise the box-like or annular projections.

The top side of the projection(s) is advantageously spaced away from, preferably above, the lid area in tight contact with the inside wall of the container, where the point of contact in the vertical direction can be virtually punctiform or linear. The cross-section of the projections can be designed in the shape of a skew triangle or rectangle, where the top and/or bottom edge of the side walls of the projections can be designed to slope down towards the inside of the container. The radially inward end wall of the projections can be vertical or at an angle. The projections can be integrally moulded on the top edge of the lid. The top edge of the projections is preferably located below the top edge of the lid, thus creating another shoulder. This avoids integral moulding at the height of the sealing region on the inside of the container, which can lead to material stress or deformation, e.g. due to shrinkage processes.

The projections facing the centre of the lid are advantageously designed such that vertically extending connecting surfaces with the circumferential sealing rib can be largely or entirely avoided in the sealing region, such as in the form of lateral surfaces on the projections or web-like projections. To this end, projections extending over a relatively large part of the circumference, or preferably a radial circumferential edge on the inside of the lid, can be provided. In this context, the lateral surfaces of the projections can be located at a radial distance from the circumferential sealing region on the top side of the projections, so that when looking at the lid from below, a circumferential groove with an e.g. roughly trapezoidal or triangular cross-section and inwardly facing wider areas results. The projections, particularly also an annular, circumferential projection, can possibly also be reinforced with inside ribs, which then preferably end at a radial distance from the sealing or support rib in contact with the inside wall of the container, or rest against it at a distance from the sealing region of this rib.

In this context, the top side of the projections can contact the inside edge of the lid essentially horizontally, preferably at a downward angle of less than 15°, e.g. 5°, towards the inside of the container.

The lid surface blocking the container opening can be positioned level with or below the inside sealing region, preferably level with or below the snap edge.

BRIEF DESCRIPTION OF THE DRAWINGS

A spout can be mounted on the lid, which is preferably located roughly at one-quarter the diameter of the lid surface area, thus resulting in practical handling of the bucket when pouring a liquid.

An example of the invention is described below and explained on the basis of the figures. The figures show the following:

FIG. 1 shows an injection-moulded plastic bucket 1 with lid 2 snapped on, where a flat area is provided on top edge 4 of outer wall 3 of the bucket. Top edge 4 is connected to a circumferential, radially-projecting collar 5, on which an outwardly projecting snap edge 6 is integrally moulded, which is engaged from below by a circumferential snap edge 7 of the lid with a hooked projection. The areas of the lid and the bucket that snap together are designed to be essentially horizontal and without rounded outer edges, so that a particularly secure snap connection is provided by the resulting interlocking connection. The snap edges of the bucket and the lid can possibly also be angled downwards towards the outside, thus strengthening the interlocking connection.

Figure 1:
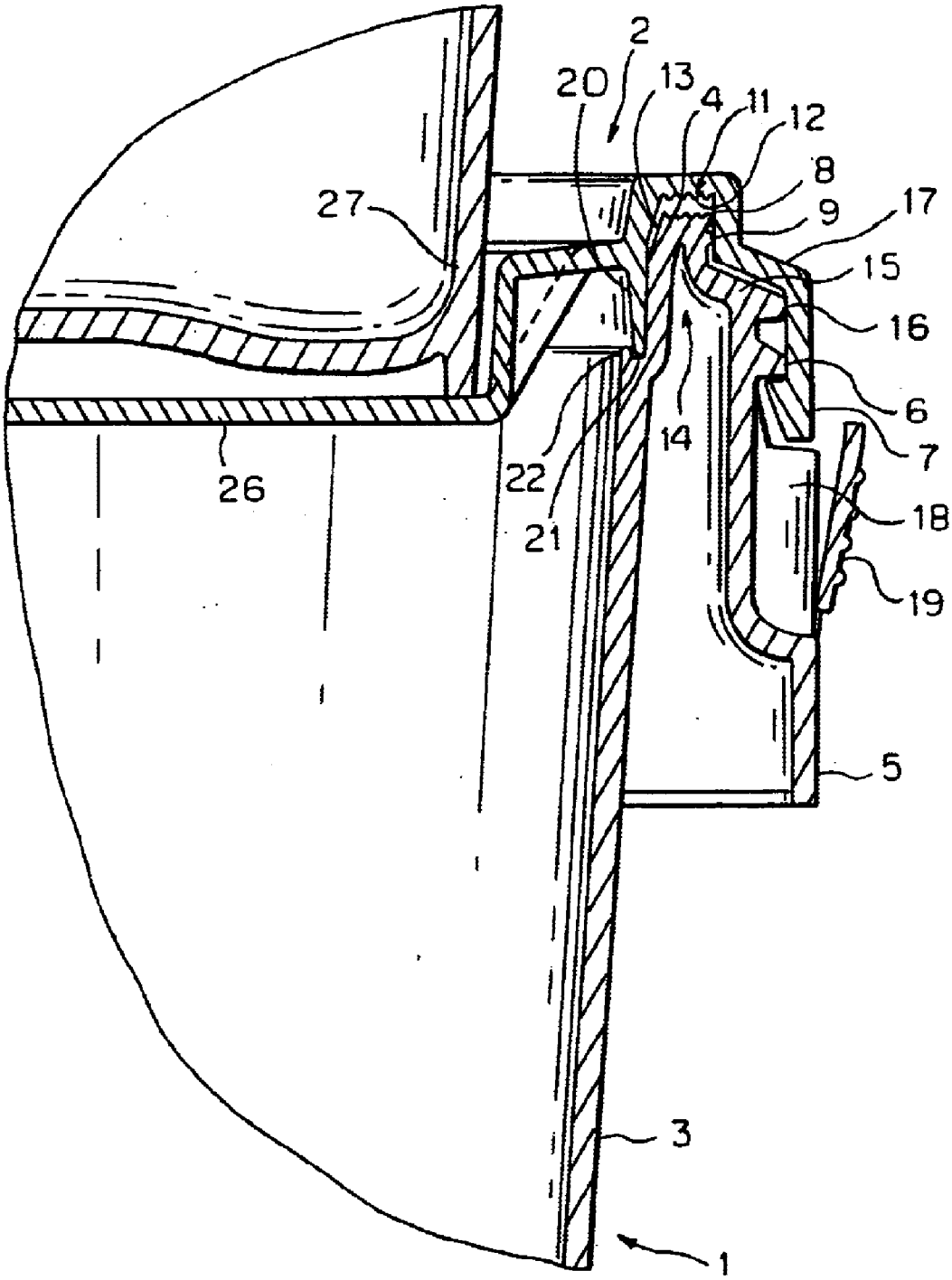
FIG. 1 A partial cross-section of a container with lid according to the invention, with another container stacked on top, FIG. 2 A detail view of a container with lid according to FIG. 1, FIG. 3 A detail cross-section of a container according to FIG. 1, FIG. 4 A top view of a container with lid according to FIG. 1, FIG. 5 A diagram of stacked lids according to FIG. 1, FIG. 6 A detail view of a container with lid according to a second configuration, FIG. 7 A detail view of a container with lid according to another configuration, FIG. 8 A diagram of stacked lids according to FIG. 7, FIG. 9 A detail cross-section of a container according to another configuration.

The region of lid 2 associated with top edge 4 of the bucket is designed in the shape of a groove or channel, where outer flank 8 of groove 34 is in lateral contact with the two, vertically spaced circumferential ribs 9 of the bucket. The radial extension of ribs 9 is considerably less than the wall thickness of the bucket, roughly one-third in this case. Due to the rounded top edge of rib 9 and the small width of the ribs, the lid can easily be pushed onto the bucket, even if sits very tightly against the edge of the bucket. Here, ribs 9 are located at the height of section 12 of the seal, where the lid can rest on the outer wall of the bucket at this height with little or virtually no pretension, even in the absence of these ribs.

A seal made of an elastic and compressible rubber material is injected as a single piece on the horizontal base of the groove in the lid and on radially adjacent inside flank 10. In order to improve the material bond, the groove base and the area of contact of the rubber seal with it are provided with congruent elevations and depressions. Sealing region 12 associated with inside groove flank 10 is at an angle to the vertical, at an angle of roughly 20° here, where the angle can also taken on values between 5 and 45°, without being restricted to this. When the lid is snapped on, angled section 12 of seal 11 rests against downwardly sloping bevel 13, which is adjacent to the inside of top edge 4 of the bucket (see also FIGS. 2, 3) and whose slope corresponds to that of the contact surface of section 12 of the seal, without being restricted to this. As a result of this special design of the seal, the bucket is securely sealed even when strong forces act on the edge of the bucket. The section of the lid that surrounds section 12 of the seal on the inside is also of bevelled design.

Circumferential collar 5 of the bucket is joined at the height of top edge 4, so that the cavity 14 delimited by collar 5 extends up close to the top edge, i.e. up to about once the wall thickness. The region of top edge 4 of the bucket is thus also designed as a U-shaped, circumferential profile.

The essentially vertical leg of U-shaped top edge 4 transitions towards the outside into a bevel 15 with an angle of roughly 30° to the horizontal, thus forming a stepped shoulder. Snap edge 6 is integrally moulded below this shoulder, where a radial, circumferential reinforcing rib 16 is integrally moulded between the snap edge and the shoulder, at the height of the shoulder here, which, in this example, is flush towards the outside with snap edge 6 and has a corresponding width, i.e. vertical extension. The bottom edge of reinforcing rib 16 is designed to correspond to that of snap edge 6, so that snap edge 7 of the lid can also engage the groove located between edge 6 an rib 16, to which end the top edge of snap edge 6 also slope down towards the outside. When completely snapped on, the edge of the lid thus rests against the outer edge of snap edge 6, reinforcing rib 16 and the two ribs 9, where a slight gap is provided between bevel 15 and sliding bevel 17 of the lid located above it. Sliding bevel 17 can also be located above the bottom edge of the lid rim surrounding the top edge of the container, so that a web projecting downwards towards bevel 15 is formed, which can possibly also rest on Circumferential collar 5 has a circumferential shoulder 28 below snap edge 7 that projects away from snap edge 7 beyond the outer edge of lid 2, where snap edge 7 can rest on shoulder 18 under pretension, or a gap can be provided between the snap edge and the shoulder. Shoulder 18 has a tamper-proof seal 19, after whose removal snap edge 7 can be grasped manually from below and the lid pulled off. Several tear-off tabs can also be provided that are adjacent or extend over a fairly large segment of the circumference of the bucker. If necessary, a tamper-proof seal can also be attached to snap edge 7. It is important to mention here that the lid area between the groove acccommodating the seal and the snap edge preferably does not have any significant thinning of the material, so that high stability, and thus high leak-proofness, is ensured between the snap connection and seal 11 or the area of the lid located inside bucket 1.

The lid has a circumferential sealing rib 20 on the inside relative to seal 11, which only tightly contacts the inside wall of the bucket along part of its height, where the sealing region 20' in this example is formed by the bottom end of the rib, which is provided roughly at the height of reinforcing rib 16 or the snap edge. Rib 20, which essentially projects vertically downward, is located at the height of an outwardly projecting should 21 of the inside wall of the bucket and at a slight vertical distance from it. When slight vertical pressure is applied to the lid, rib 20 rests on indentation 21. If the sealing function of the rib is dispensable, individual, downward-facing, web-like projections can also be provide as an alternative. Indentation 21 is delimited on the inside by a circumferential ridge 22, in place of which individual projections can also be provided, where ridge 22 extends above the bottom edge of rib 20 and prevents the inward movement of rib 20. Rib 20 can also be received in a press fit between ridge 22 and the adjacent, outer wall area of the bucket. The sealing region of rib 20 is formed in that (see FIG. 2) rib 20 is angled slightly outward and dimensioned such that its bottom edge 35 would come to rest radially outside the inside wall of the bucket when the lid is removed. In this case, the thickness of the bottom edge roughly corresponds to the rib thickness, preferably more than ¼ of the same, where it is slightly tapered here. As a result, radially pretensioned contact with the inside wall of the container is consistently achieved when the lid is on. The overhang when the lid is removed is smaller than the rib thickness here and amounts to roughly ¼ the thickness of the bottom edge.

A circumferential, inside edge 23 sloping slightly down towards the inside, is integrally moulded on rib 20 above the sealing region 20' and below the seal 11 in the region of the top edge of the container (ef. also FIG. 4), on which inwardly facing bevels 24 or, in spots with a wider edge, essentially vertical wall areas 25 are integrally moulded in segments, which transition into the horizontal lid area 26. Area 26 is located below snap edge 6, where its outside diameter is dimensioned, as shown, such that it is possible to stack buckets. This results in triangular projections that are integrally moulded on a trapezoidal groove open towards the bottom.

In order to enable improved force transmission in, and simultaneous stackability of, buckets without lids inside one another, outer wall 3 of the bucket has a taper or angle to the outside of less than 3°, preferably 2°, where smaller angles are also possible. In order to be able to better absorb in the edge region the forces that occur when buckets with lids are stacked, the distance between the side of wall 25 of the projections facing the centre of the bucket and the opposite outer wall 27 of the bucket is further designed to allow only slight play, e.g. with a distance of less than 2 mm, preferably 1 mm.

Figure 2:
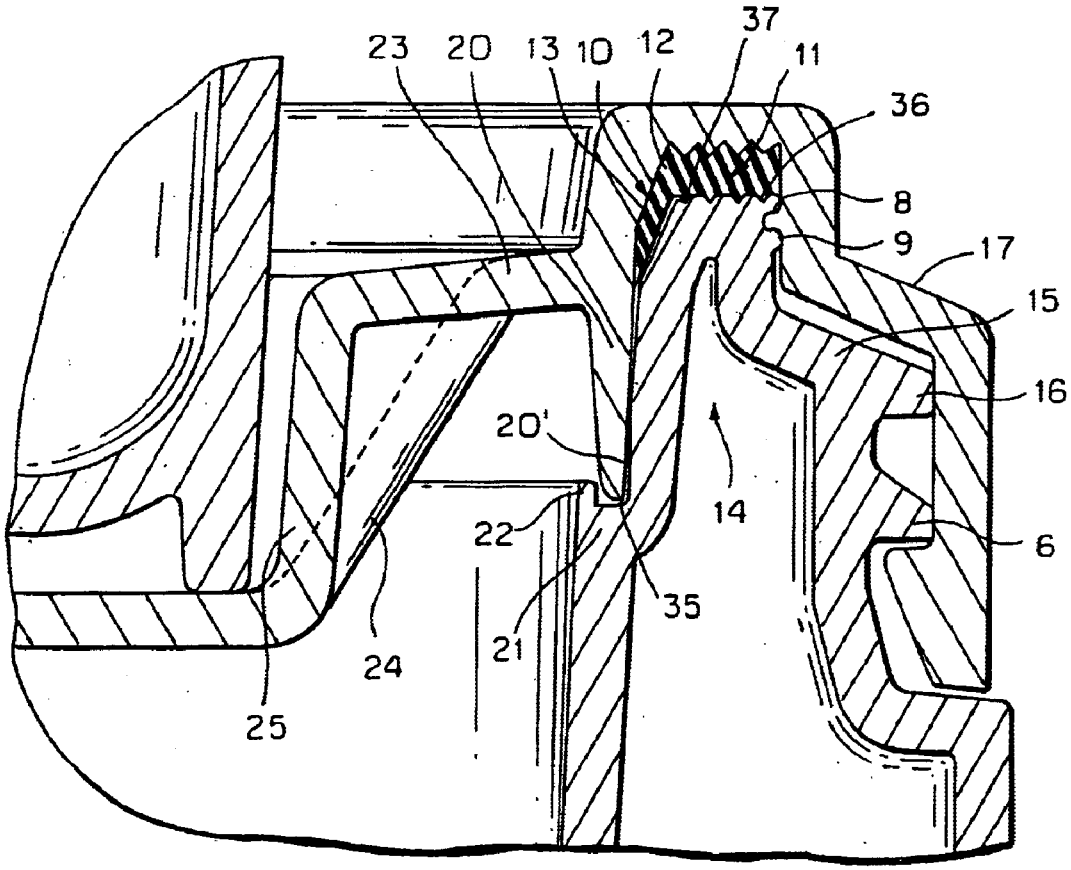
Figure 3:
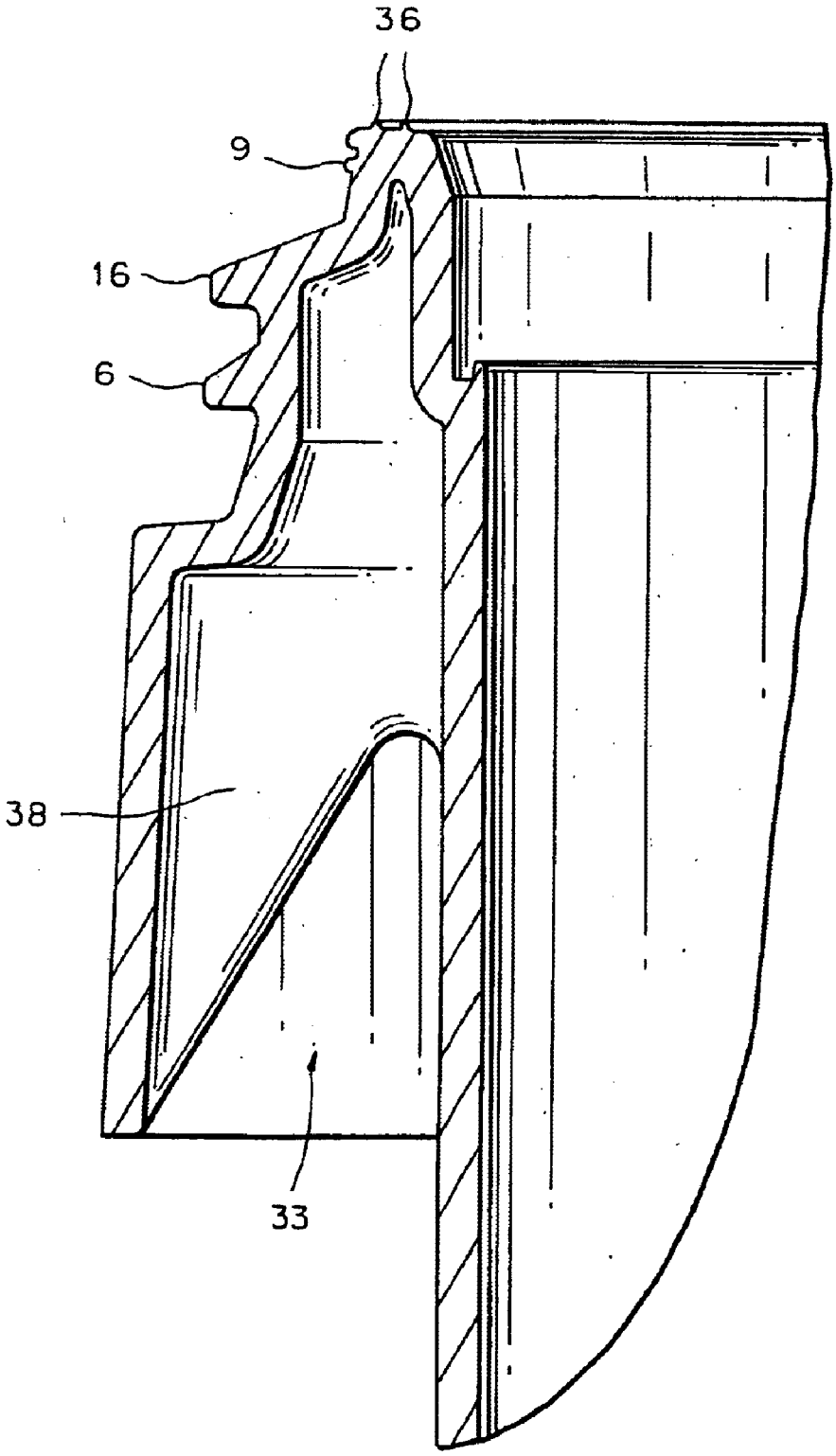

As shown in the enlarged diagrams in FIGS. 2 and 3, top edge 4 of the bucket collar is equipped with two, circumferential ribs 36, which engage the teeth on the underside of seal 11, where some of the downwardly projecting ribs 37 of the teeth of the seal come into contact with ribs 36 on the top edge of the bucket, e.g. in their flank region, thus preventing lateral shifting of ribs 37, and some make contact next to ribs 36 in the groove formed between them, or outside of this on container edge 4. This incongruent design of the two structures makes the bucket highly leak-proof.

As further illustrated by the Figure, vertical reinforcing ribs 38 that run perpendicular to the outer wall are provided in cavity 14, which have recesses 33 open towards the bottom, where the apex of the recess is offset towards the outer wall of the bucket.

Figure 4:
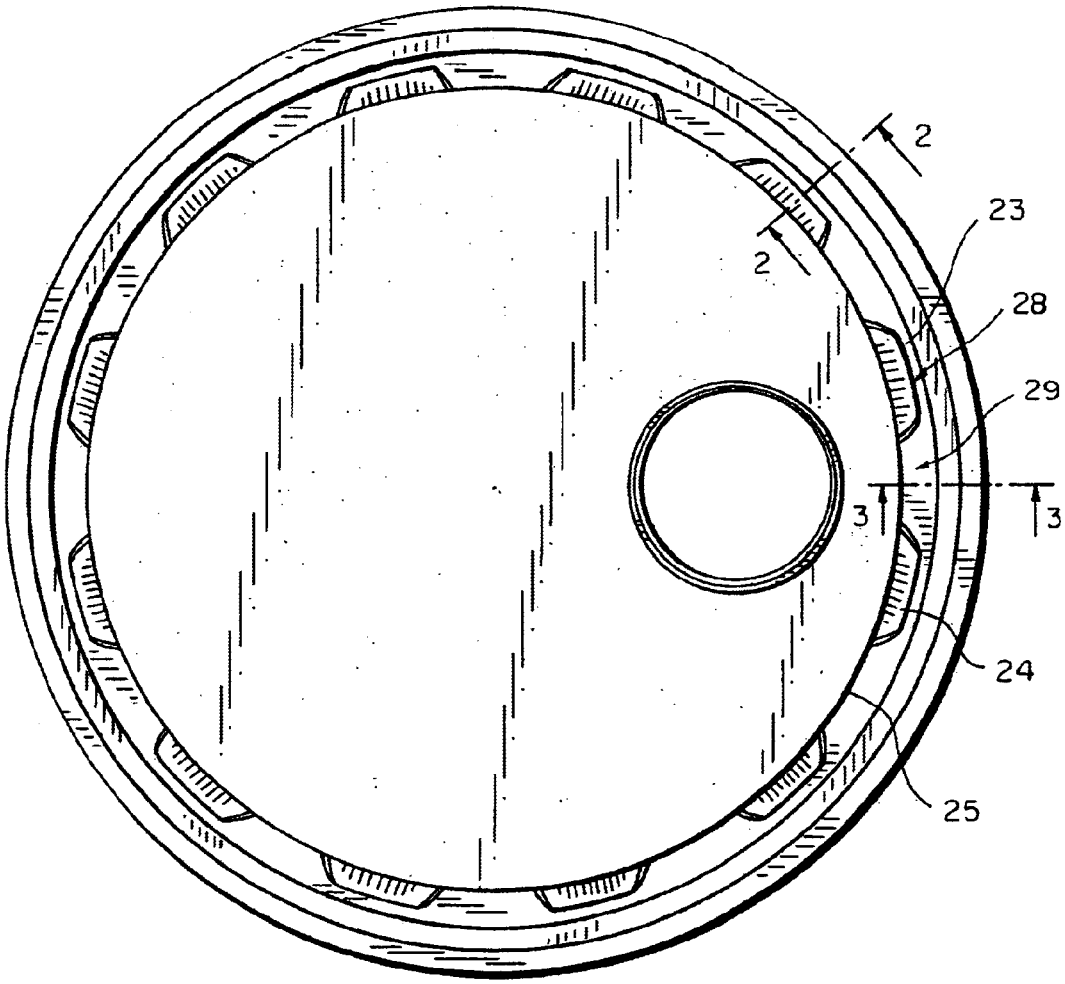

As shown in FIG. 4, circumferential edge 23 of the lid, which is located on the inside of container wall 3, is provided with segments 28, 29 of different radial width, this resulting in an effective reinforcing profile, in order to absorb forces on the sealing region of rib 20 or seal 11. The circumferential extension of segments 28, 29 is a multiple of their width, so that essentially box-shaped projections result. Bevels 24 and vertical wall areas 25 end at the same distance from the main axis of the bucket, where areas 30 delimiting bevel 24 on the side are inclined towards the periphery of the lid.

A closable spout, which is located at about one-quarter the diameter of the bucket, is also located in the central area 26 of the lid.

Figure 5:
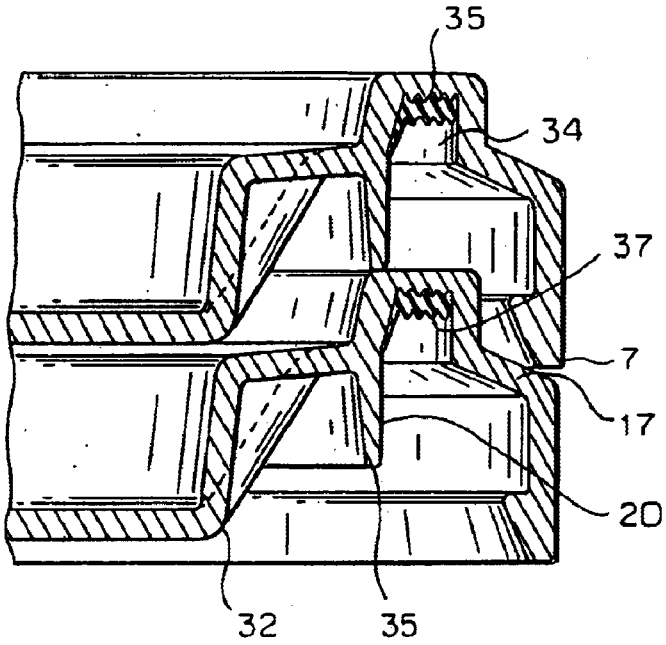

As shown in the stacking diagram in FIG. 5, the bottom edge of snap edge 7 of the lid rests on sliding bevel 17, and bottom edge 35 of sealing rib 20 on horizontal leg 31 of groove 34 holding seal 11. The bottom edge of box-shaped projection 32 can alternatively or additionally rest on the top edge of the projection of the lid below.

Figure 6:
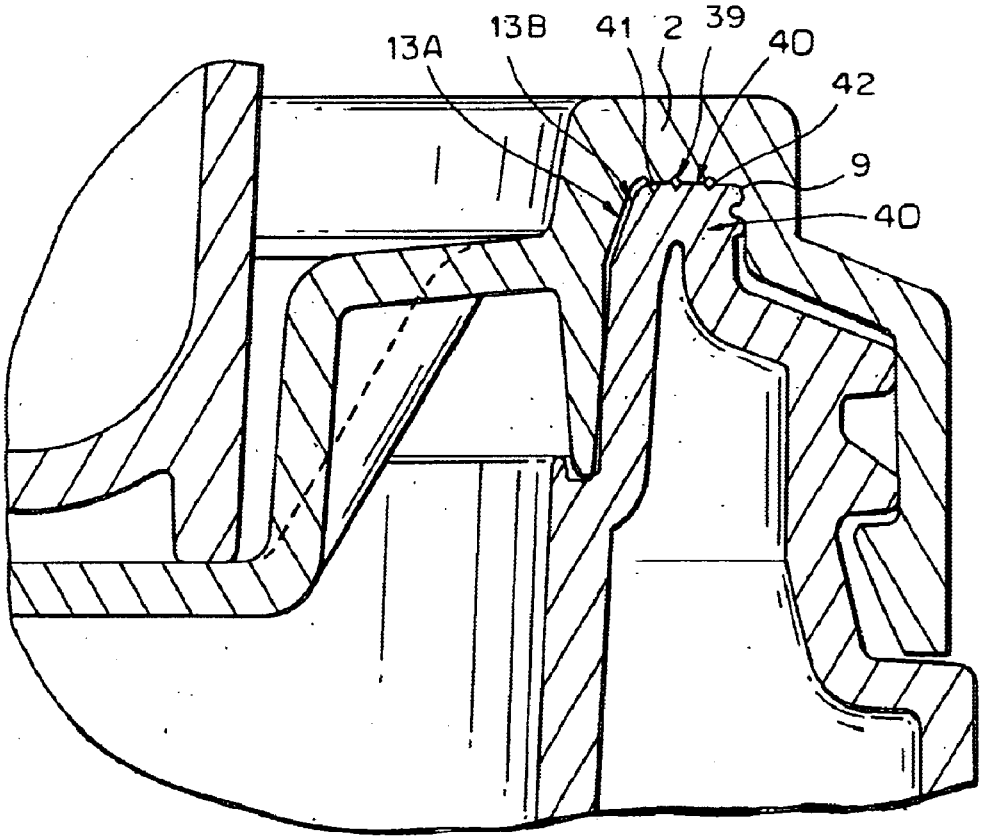

FIG. 6 shows a container with lid, where in contrast to the practical example in FIG. 1, sealing region 39 is formed between top edge 40 of the container and lid 2 by areas that respectively form parts of the lid and the container. Top edge 40 of the container is engaged by circumferential groove 34 of the lid; if necessary, the lid can also only surround the outside of the container collar.

Upwardly and downwardly projecting, integrally moulded sealing ribs 41, 42 (two or three in each case), which are made of the same material as the container or lid, are again provided on the horizontal top edge of the container and on the corresponding contact area of the lid (on the base of the groove in this case). Sealing ribs 41, 42 are positioned such that they partly rest on top of one another and partly come into full contact with the adjacent contact area of the sealing region. The width of horizontal sealing region 39 is again greater here than the wall thickness of the container, more specifically 1.5 to 2 times greater.

Areas 13*a*, 13*b* of the lid and the container, which are radially adjacent to the inside of the sealing region of the top edge of the container, slope down towards the inside of the container, with a slope of more than 60° in this case, where the lid and the container can have slight play or also be in contact with one another.

Otherwise, the container with lid according to this practical example has the features of the first practical example, which is referred to in this context.

Figure 7:
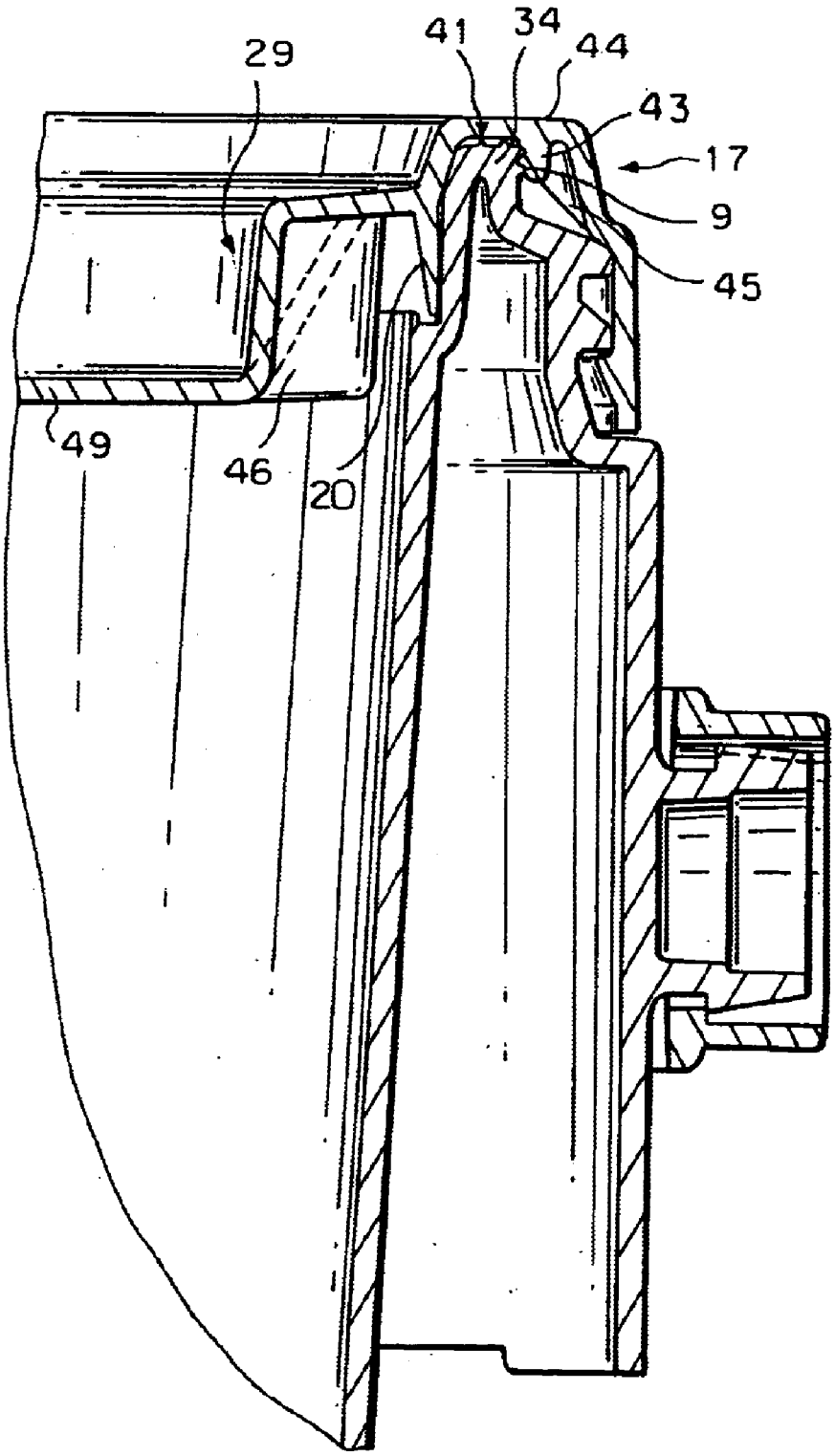

FIG. 7 shows another practical example in which, in contrast to the one in FIG. 6, sealing ribs 41 are only provided on the top edge of the container and groove 34 that receives top edge 40 of the container is of plane design. Of course, sealing ribs can also be provided only on the contact area of the lid. Sealing ribs 41 are made of the same material as the container and are integrally moulded. Here, top edge 40 of the container is surrounded on the outside by a circumferential, downwardly projecting web 43, which is in close contact with outwardly projecting, circumferential ribs 9 of the container. Horizontal lid area 44, which forms the base of the groove, extends radially outward beyond web 43, so that sliding bevel 17 is steeper than in the previous practical examples. Reinforcing ribs 45 can be provided between web 43 and sliding bevel 17.

Moreover, essentially vertical reinforcing ribs 46, which are connected to the outer, essentially vertical and essentially horizontal areas of projecting segments 29 and end in front of circumferential sealing rib 20, are provided on projections 29 provided on the inside of the lid. The reinforcing ribs can also be extended up to sealing rib 20, where they preferably do not, however, contact the sealing edge in linear fashion, in order to avoid leaks due to shrinkage, particularly not at the height of the sealing contact area of the sealing rib on the inside wall of the container, or with a vertical area, whose vertical extension is substantially smaller than the vertical extension of the reinforcing rib at the height of the inside edge of the projection. Reinforcing ribs 45 of such design can also be correspondingly provided on a inside, circumferential edge of the lid, which is not divided into projecting and receding areas. In this context, inside lid area 49 is located below the bottom edge of the sealing rib, where reinforcing ribs 46 are preferably joined at the height of the inside lid area or below the bottom edge of sealing rib 20 on the inside wall of the projections or the circumferential edge, without be restricted to this.

Figure 8:
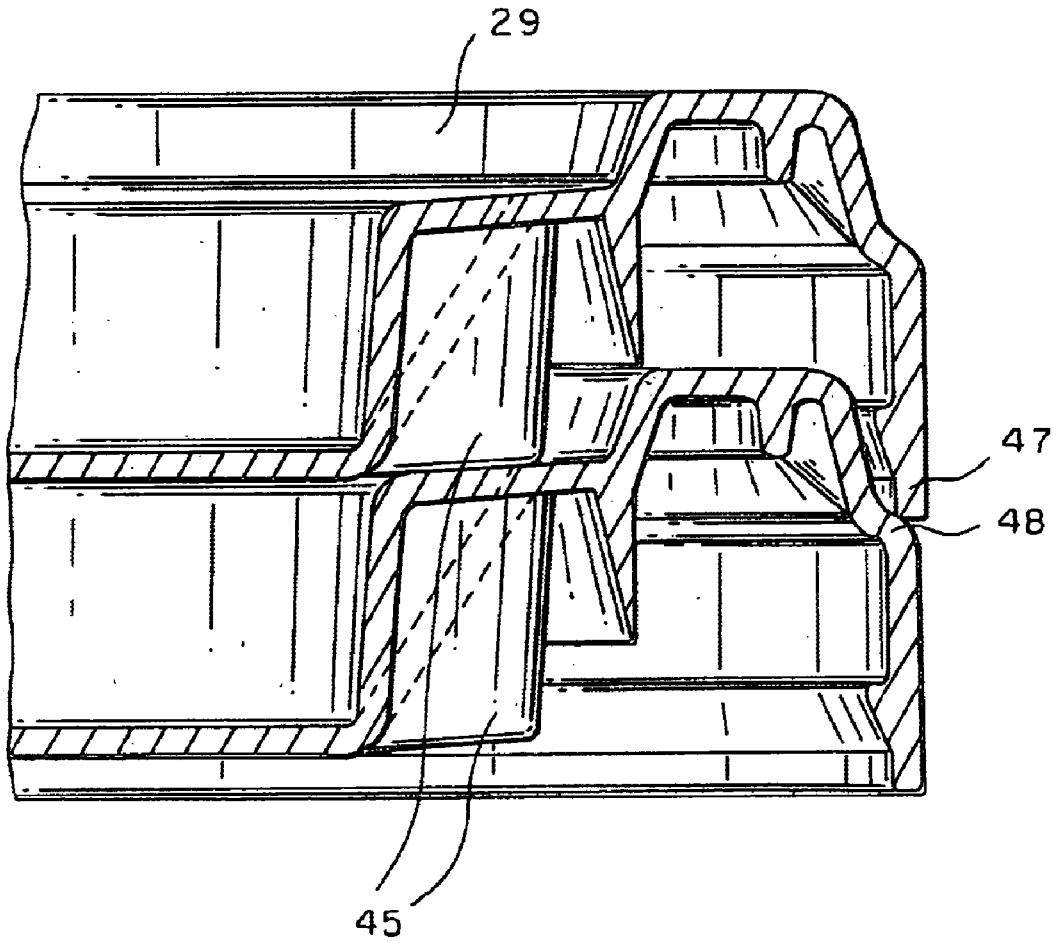

As shown in the stacking diagram in FIG. 8, reinforcing ribs 45 can simultaneously serve the purpose of providing support on the lid below and rest in linear or punctiform fashion on the top side of inside projections 29 or the circumferential edges. In addition, the lid is supported on the lid below by web 47 projecting downwards below the snap edge resting on circumferential shoulder 48 surrounding sliding bevel 17. In this context, sealing rib 20 is at a distance from the adjacent lid and can, if necessary, also rest on it.

Of course, the stacking pattern in the diagram can also be realised for other configurations of the container or lid, particularly other configurations of the sealing region on the top edge of the container.

Figure 9:
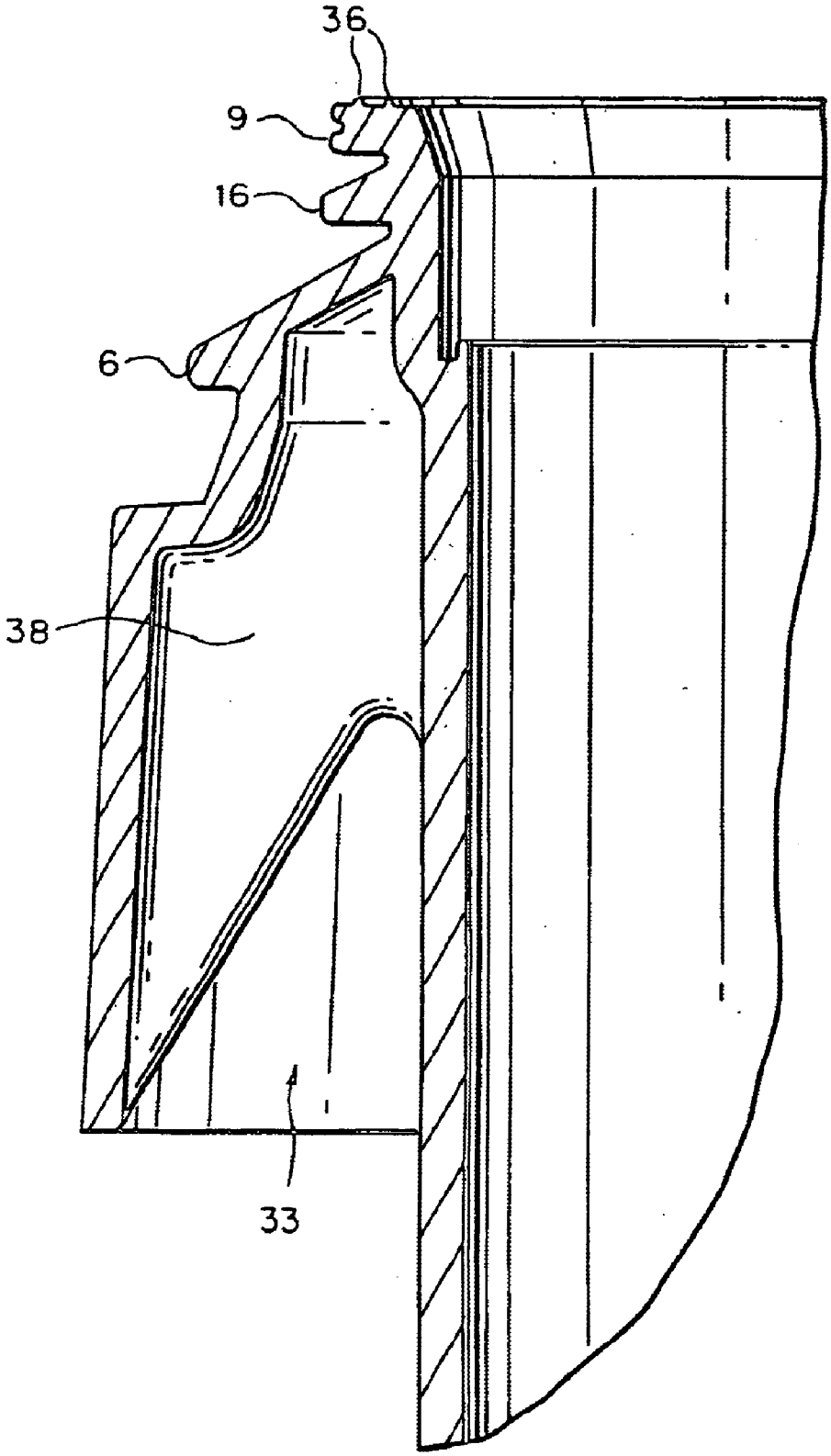

FIG. 9 shows another configuration of a container that represents a modification of the container according to FIG.

1. Identical features are labelled with the same reference numbers. The difference compared to the lid according to FIG. 1 lies in the arrangement of reinforcing rib 16, which is located immediately on outer wall 3 of the container in this case. According to this practical example, the inside of the snapped-on lid again rests laterally on the outside of reinforcing rib 16. The reinforcing rib is roughly as thick as the container wall. Reinforcing rib 16 projects radially up to the radial outside surface of ribs 9. Although this practical example can be realised, the configuration of the container according to FIG. 1 is particularly advantageous, because the reinforcing rib stabilises circumferential collar 5 there and interacts particularly advantageously with the area of the container wall acting on circumferential rib 20.

| List of reference numbers | |
|---|---|
| 1 | Bucket |
| 2 | Lid |
| 3 | Outer wall |
| 4 | Top edge |
| 5 | Collar |
| 6, 7 | Snap edge |
| 8 | Outer flank |
| 9 | Rib |
| 10 | Flank |
| 11 | Seal |
| 11a | Sealing rib |
| 12 | Vertical section |
| 13a, 13b | Bevelled area |
| 14 | Cavity |
| 15 | Bevel |
| 16 | Reinforcing edge |
| 17 | Sliding bevel |
| 18 | Shoulder |
| 19 | Tamper-proof seal |
| 20 | Sealing rib |
| 21 | Indentation |
| 22 | Ridge |
| 23 | Edge |
| 24 | Bevel |
| 25 | Wall |
| 26 | Area |
| 27 | Outer wall |
| 28, 29 | Segment |
| 30 | Area |
| 31 | Horizontal leg |
| 32 | Bottom edge |
| 33 | Recess |
| 34 | Groove |
| 35 | Bottom edge |
| 36, 37, 38 | Rib |
| 39 | Sealing region |
| 40 | Top edge |
| 41, 42 | Sealing ribs |
| 43 | Web |
| 44 | Lid area |
| 45, 46 | Reinforcing ribs |
| 47 | Web |
| 48 | Shoulder |
| 49 | Inside lid area |

What is claimed is:

1. A plastic container with a snap lid, the container having a top edge and a snap element provided on an upper edge area of the container for the lid to snap onto, where the lid has an area that comes into tight contact with the upper edge area of the container, areas of the lid and container coming into tight contact generating a sealing region, at least one integrally molded reenforcing rib provided above a top side of the snap elementary addition to the sealing region and being arranged vertically between the snap element and the top edge of the container an projecting radially outward and extending over at least a segment of the circumference of the container, wherein an upper region of the container has a radially projecting, at least substantially, vertically downward-facing circumferential collar region on an outside, which is joined in a region of the top edge of the container where the snap elements integrally molded.

2. The container according to claim 1, wherein the at least one reinforcing rib is located on the circumferential collar region.

3. The container according to claim 1, wherein at least one reinforcing rib is located above the circumferential collar region right on the container wall.

4. The container according to claim 1, wherein the lid rests on a radially terminating side of the reinforcing rib provided at a wall of the container.

5. The container according to claim 1, wherein the sealing region between the container and the lid is provided with a circumferential seal made of a material of greater elasticity than that of the container and the lid.

6. The container according to claim 5, wherein the seal is injection moulded on at least one of the areas of the container and the lid generating the sealing region.

7. The container according to claim 5, wherein the lid has a circumferential groove to receive the top edge of the container and that the seal is located in the groove.

8. The container according to claim 5, wherein the container has main axis and that the seal has two, sealing regions spaced apart that are at different angles to the main axis of the container, and that in the snapped on state of the lid both sealing regions of the lid are in tight contact of cooresponding areas of the container.

9. The container according to claim 5, wherein the seal has an area that contacts an area of the container that is radially inward relative to the top edge of the container and slopes downward towards the inside of the container.

10. The container according to claim 5, wherein the sealing region of the container and lid is provided with the at least one circumferential sealing rib projecting towards a corresponding component of the sealing region, the component being one of a group consisting of the container and the lid, the sealing rib tightly contacts the corresponding component.

11. The container according to claim 10, wherein a height of the sealing rib is less than the wall thickness of the container.

12. The container according to claim 5, wherein at least one web projecting radially outward is integrally moulded on an outside area adjacent to the top edge of the container, whose radial extension is less than the container wall thickness.

13. The container according to claim 1, wherein the lid has a circumferential area that directly and tightly contacts the inside wall of the container.

14. The container according to claim 13, wherein the circumferential area is designed as a circumferential rib projecting downward from an underside of the lid.

15. The container according to claim 14, wherein an area projecting upwards beyond a bottom edge of the rib is provided on the inside wall of the container radially inward relative to the circumferential rib.

16. The container according to claim 13, wherein the reinforcing rib is located at least substantially a height of an area of the lid that directly contacts an inside wall of the container.

17. The container according to claim 13, a top side of at least one projection is spaced vertically away from the area of the lid in tight contact with the inside wall of the container.

18. Container according to claim 17, wherein at least one projection is designed as a radial edge running circumferentially around the inside of the lid.

19. Container according to claim 18, wherein inward-facing projections are integrally moulded on the circumferential edge.

20. The container according to claim 5, wherein the lid is provided radially inwards from the inside wall of the container with at least one projection injection moulded on the top side of the lid and extending towards a main axis of the container.

21. The container according to claim 1, wherein the lid has an are that contacts an area of the container that is radially inward relative to the top edge of the container and slopes downward towards the inside of the container.

22. The container according to claim 1, wherein the sealing region of the container and lid is provided with at least one circumferential sealing rib projecting towards a corresponding component of the sealing region, the component being one of a group consisting of the container and the lid, the sealing rib tightly contacts the corresponding component.

23. container according to claim 22, wherein a height of the sealing rib is less than the wall thickness of the container.

24. The container according to claim 1, wherein at least one web projecting radially outward is integrally moulded on an outside area adjacent to the top edge of the container, whose radial extension is less than a container wall thickness.

25. The container according to claim 1, wherein the lid has a circumferential area that directly and tightly contacts an inside wall of the container.

26. The container according to claim 25, the circumferential area is designed as a circumferential rib projecting downward from the underside of the lid.

27. The container according to claim 26, wherein an area projecting upwards beyond a bottom edge of the rib is provided on the inside wall of the container radially inward relative to the circumferential rib.

28. The container according to claim 25, wherein the reinforcing rib is located at least substantially at a height of an area of the lid that directly contacts an inside wall of the container.

29. The container according to claim 25, wherein a top side of at least one projection is spaced vertically away from an area of the lid in tight contact with the inside wall of the container.

30. The container according to claim 29, wherein at least one projection is designed as a radial edge running circumferentially around the inside of the lid.

31. The container according to claim 30, wherein inward-facing projections are integrally moulded on the circumferential edge.

32. The container according to claim 1, wherein the lid is provide radially inwards from an inside wall of the container with at least one projection integrally moulded with the top side of the lid.

33. A plastic container with a snap lid, the container having a top edge and a snap element provided on an upper edge area of the container for the lid to snap onto, where the lid has an area that comes into tight contact with the upper edge area of the container, areas of the lid and container coming into tight contact generating a sealing region, at least one integrally molded reinforcing rib provided above a top side of the snap element in addition to the sealing region and being arranged vertically between the snap element and the top edge of the container and projecting radially outward and extending over at least a segment of the circumference of the container, wherein an upper region of the container has a radially projecting, at least substantially vertically downward-facing circumferential collar region on an outside, which is joined in the region of the top edge of the container, where the snap element is integrally molded, and wherein the at least one reinforcing rib is located on the circumferential collar region.

34. A plastic container with a snap lid, the container having a top edge and a snap element provided on an upper edge area of the container for the lid to snap onto, where the lid has an area that comes into tight contact with the upper edge area of the container, areas of lid and container coming into tight contact generating a sealing region, at least one integrally molded reinforcing rib provided above a top side of the snap element in addition to the sealing region and being arranged vertically between the snap element and the top edge of the container and projecting radially outward and extending over at least a segment of the circumference of the container, wherein the lid is provided radially inwards from an inside wall of the container with at least one projection integrally molded with a top side of the lid, and wherein the at least one reinforcing rib is located at level of the projection and vertically spaced apart from a sealing region provided at the top edge of the container.

35. The container according to claim 34, wherein an upper region of the container has a radially projecting, at least substantially vertically downward-facing collar region, wherein the at least one reinforcing rib is located on the circumferential collar region projecting radially outward and at least substantially vertically facing downward.

36. A plastic container with a snap lid, the container having a top edge and a snap element provided on an upper edge area of the container for the lid to snap onto, wherein (1) the lid has an area that comes into tight contact with the upper edge area of the container, the areas of the lid and container coming into tight contact generating a sealing region, the sealing region being provided at a top edge of the container, or (2) wherein a sealing region between the container and the lid is provided with a circumferential seal made of a material of greater elasticity than that of the container and the lid, wherein on the side of the snap element facing the top edge of the container is provided with at least one integrally molded reinforcing rib additionally to the sealing region and being arranged vertically between the snap element and the top edge of the container and projecting radially outward and extending over at least a segment of the circumference of the container, and wherein the at least one reinforcing rib is vertically spaced from the sealing region at the top edge of the container or from the seal made of a material of greater elasticity than that of the container and the lid.

37. A plastic container with a snap lid, the container having a top edge and a snap element provided on an upper edge area of the container for the lid to snap onto, (1) wherein the lid has an area that comes into tight contact with the upper edge area of the container, the areas of lid and container coming into tight contact generating a sealing region, the sealing region being provided at a top edge of the container, or (2) wherein a sealing region between the container and the lid is provided with a circumferential seal made of a material of greater elasticity than that of the container and the lid, wherein on the side of the snap element facing the top edge of the container, the container is provided with at least one integrally molded reinforcing rib in addition to the sealing region and being arranged vertically between the snap element and the top edge of the container and projecting radially outward and extending over at least a segment of the circumference of the container, wherein the at least one reinforcing rib is vertically spaced from the sealing region at the top edge of the container or from the seal made of a material of greater elasticity than that of the container and the lid, and wherein an upper region of the container has a radially projecting, at least substantially vertically downward-facing circumferential collar region on a outside, which is joined in the region of the top edge of the container, wherein the snap element is integrally molded at the at least substantially vertically downward-facing circumferential collar region.

* * * * *